United States Patent [19]

White

[11] Patent Number: 4,651,355

[45] Date of Patent: Mar. 24, 1987

[54] REPLACEMENT POCKET

[76] Inventor: McNeil White, P.O. Box 267, Wilberforce, Ohio 45384

[21] Appl. No.: 852,736

[22] Filed: Apr. 16, 1986

[51] Int. Cl.[4] ..... A47D 27/20

[52] U.S. Cl. ..... 2/247

[58] Field of Search ..... 2/247, 248, 249, 250, 2/251, 252, 253, 254

[56] References Cited

U.S. PATENT DOCUMENTS 3,438,062 4/1969 Dobell ..... 2/247

3,840,901 10/1974 Eystor ..... 2/247

*Primary Examiner*—Doris L. Troutman

*Attorney, Agent, or Firm*—Donald P. Gillette

[57] ABSTRACT

A replaceable patch type pocket with fastener at the corners of the pocket for attaching the pocket to the surface of a garment.

8 Claims, 4 Drawing Figures

REPLACEMENT POCKET

BACKGROUND OF THE INVENTION

This invention relates to replaceable pockets for garments and particularly to replaceable hip pockets that may be used on jeans and replaced whenever desired, either for utility or for reasons of style.

The idea of attaching pockets to garments by means of snap fasteners is shown in the prior art, such as Frohman, U.S. Pat. No. 2,591,059; Nicholson, U.S. Pat. No. 2,810,132; and Corley, U.S. Pat. No. 2,908,982. Frohman proposes to replace a torn pocket in pants by cutting most of the torn pocket away, except for a specific remnant, and attaching to the remnant a new pocket that has snap fasteners with cloth-piercing heads on one part of each fastener. The heads pierce the remnant fabric and engage receptacle fastener portions on the facing layer of fabric that forms part of the new pocket. By so doing, the new pocket is clamped onto the remnant without any complex or difficult sewing operations. The replacement pocket is an entire pocket, with part of its perimeter being defined by a fold in the pocket fabric and another part being formed by previously stitched juxtaposed edges of the pocket material. Only the edge portions adjacent which the snap fasteners are mounted are not joined together, which is obviously necessary to allow entry to the pocket.

The upper half of Nicholson's pocket is permanently sewn to a child's jeans so that the pocket is not easily replaceable. The pocket is twice as long, vertically, as it need be, and it has a holster for a toy gun attached to its outer surface. When the child is not playing with a gun, the lower half of the pocket material may be folded approximately about the horizontal center line of the material, and the two lower corners snapped onto the upper two corners by mating fasteners attached to the respective corners. In that configuration, the material forms somewhat of a pocket, but its vertical edges are open, and anything put into it, other than something relatively large, would be expected to fall out.

Corley provides a complete pocket structure, with corner snap fastener components and another such component midway between the two corners at the open end of the pocket. These components engage mating components attached to the inside surfaces of hip boots for the purpose of releasably attaching the pockets inside the boots in position for use as hand warmers. At the same time, the fact that the pockets are releasable allows them to be removed to be cleaned or dried or replaced easily. Each pocket is complete; it does not rely on the surface to which it is attached to form one of the two pocket layers. Also, the edges of the pocket are joined together permanently, as is customary with pockets in garments, and the layers are not releasably joined by means of Velcro and sturdy stud fasteners.

Dobell, U.S. Pat. No. 3,438,062, shows a patch pocket consisting of a single layer that forms the outer layer of the pocket and is joined to the outer surface of a jacket by a curved Velcro strip that extends down one of the vertical edges, around the bottom, and up the other vertical edge. Two snap fastener elements are provided at the upper corners to engage mating fastener elements on the jacket to help align the pocket properly. The part of the jacket over which the outer pocket layer fits constitutes the inner layer. While the side and bottom edges are closed by means of the Velcro, it is extremely difficult, if not impossible, to sew Velcro along a sharply curved arc in the manner indicated by Dobell, and it would be very expensive to get wide Velcro and cut it according to an arcuate shape.

OBJECTS AND SUMMARY OF THE INVENTION

It is one of the objects of the present invention to provide a detachable, or releasable pocket layer to be attached firmly to the outer surface of a garment by stud fasteners and strips of Velcro to allow as much stress to be placed on the pocket as could be placed on the same pocket material if it were sewn to the garment and yet to allow the pocket to be removed and replaced far more easily than could be done if the stitches holding it in place had to be cut and new stitches had to be sewn to hold the replacement pocket layer in place.

Another object is to provide a detachable outer pocket layer with hidden stud fastener elements and with protective layer means to prevent undue wear on those areas of the pocket material that cover the stud fasteners.

Still another object is to provide a pocket layer releasably attached to a garment by stud fasteners at the corners and by straight strips of Velcro that extend substantially the entire distance from one stud fastener to the next.

Further objects will appear in the following written material, together with the accompanying drawings.

In accordance with this invention, one part of a stud fastener is firmly attached to upper and lower corners of a layer of pocket material, and a mating part of the stud fasteners is attached to correspondingly spaced locations on the surface of a garment at the location where the outer pocket layer is to be placed. Straight strips of Velcro material are nonreleasably attached to the pocket layer material to extend from adjacent each of the stud fasteners to the next, except between the two stud fasteners at the upper corners of the pocket. It is well known that there are two types of Velcro material: one that is formed as ribbon, or tape, woven so that tiny, relatively rigid plastic hooks are embedded in it and extend from one surface in closely spaced rows and columns; and the other as woven tape or ribbon that has loops that are much more flexible than the hooks extending from one surface in a random pattern. When the hooks and the loops are brought into engagement with each other, they lock together firmly, but they can be separated by peeling the ribbons apart. Straight strips of one of the types of Velcro material must be attached to the pocket layer, and straight strips of the other type of Velcro material must be attached to the garment in position to be engaged by the pieces of the first type of Velcro material when the outer pocket layer is snapped onto the garment.

In order to place the stud fastener elements on the outer pocket layer so that they will be hidden from view while the pocket is attached to the garment, the outer pocket layer is provided with flaps along its edges, and the stud fastener elements that are to be attached to the outer pocket layer are attached to the flaps in locations such that, when the flaps are fold back against the adjacent edge portion of the pocket layer, the stud fastener elements will be properly positioned close to the corners. The straight pieces of one of the two types of Velcro material must also be sewn on the flaps, but, as they are initally positiioned, they will not extend from one stud fastener element to the next. That will only be true after the flaps have been folded over and sewn to the main part of the pocket material.

One of the problems of having the stud fastener elements located on the folded-over flaps is that the part of the outer layer of pocket material directly over the stud fastener elements is likely to receive extra wear. To prevent that from happening, a protective layer is placed between the stud fastener element and the inner surface of the part of the outer pocket layer that would otherwise be directly in contace with the stud fastener. The protective layer can be a separate piece of material, but it can also be an end portion of the next-adjacent flap, cut so that it can underlie the stud fastener element.

DETAILED DESCRIPTION OF THE INVENTION

Figure 1:
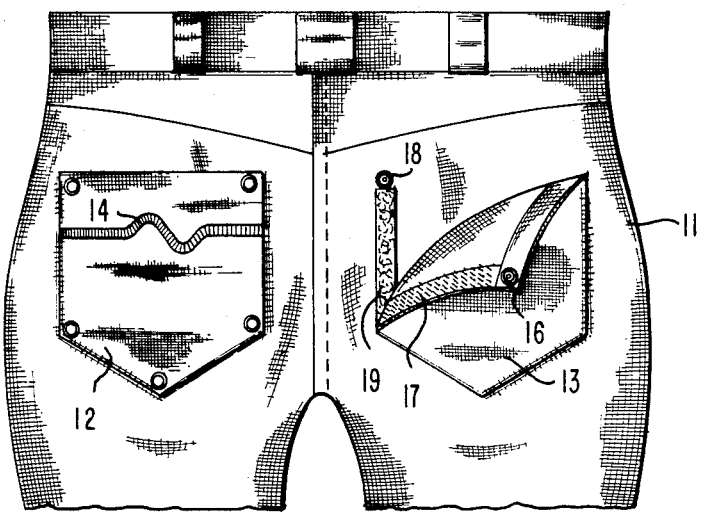
FIG. 1 shows a pair of jeans that have hip pockets made and attached according to this invention.

FIG. 1 shows a portion of a pair of jeans 11 with two pockets 12 and 13 on them. The pocket 12 is indicated as having a pattern 14 formed on it, for example, by stitching. While the fact that this pocket is releasably attached to the jeans is not completely shown in FIG. 1, that is, in fact, the case, and one of the reasons for making it so is that it may be desirable to replace the pocket from time to time with other pockets having other emblems formed on them. The pockets could also be made of different types of material, for example, denim of a different color than the jeans, or material of a different sort, such as leather.

The pocket 13 may or may not match the pocket 12 in the type of material of which it is made or in the type of ornamentation on it. As shown in FIG. 1, the upper left part of the pocket 13 is peeled back to show some of the attachment means. The part shown consists of a stud fastener element 16 on the outer pocket layer, an adjacent piece of straight Velcro material 17 of one type, a stud fastener element 18 firmly attached to the jeans 11 at a location that would be directly juxtaposed to the stud fastener element 16, if the upper left corner were not folded back, and a piece of Velcro material 19 of the second type that would also be directly juxtaposed with the piece of Velcro material 17 if the upper left corner of the outer pocket layer were in place.

Figure 2:
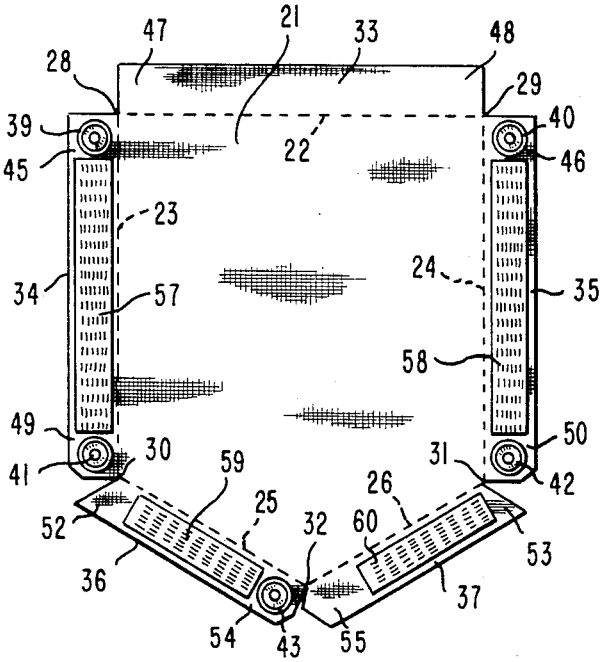
FIG. 2 shows an outer pocket layer as initially formed and before the flaps along its edges have been folded back.

FIG. 2 shows an intermediate stage of manufacture of the pocket 21, or more precisely, the outer layer of the pocket, since it is to be understood that the inner layer will be the garment to which the outer layer is to be attached. The outer layer 21 has a top edge 22, which is indicated by a dotted line. After the manufacturing process is complete and the flaps have been folded into place, the edge 22 will, in all respects, be the top edge, just as other edges, which are indicated in FIG. 2 by dotted lines, will be on the periphery of the finished outer pocket layer. These other edges are: first and second side edges 23 and 24, and first and second bottom edges 25 and 26. While the pocket 21 is shown as having give edges, it need not have that number; there may be four or six, but very seldom more than six. The side edges 23 and 24 intersect the top edge 22 at first and second upper corners 28 and 29, and they intersect the bottom edges 25 and 26 at first and second lower corners 30 and 31, which are substantially below the corners 28 and 29, respectively. The bottom edges intersect at an obtuse corner 32.

The edges 22–26 have flaps 33–37, respectively, extending outwardly from them. In order to have stud fastener elements that will be near the corners 28–32 after the flaps 33–37 have been folded back against the immediately adjacent portions of the main part of the layer 21, i.e. against edge portions thereof, two stud fastener elements 39 and 40 of a first set 39–43 of such elements are shown firmly and nonreleasably attached to end portions 45 and 46 of the flaps 34 and 35, which are next-adjacent the end portions 47 and 48 of the flap 22. Similarly, the stud fastener elements 41 and 42 are firmly and nonreleasably attached to opposite end portions 49 and 50 of the flaps 34 and 35. These are next-adjacent to end portions 52 and 53 of the flaps 36 and 37. The stud fastener element 43 is firmly and nonreleasably attached to the end portion 54 of the flap 36, which is next-adjacent to the end portion 55 of the flap 37.

Figure 3:
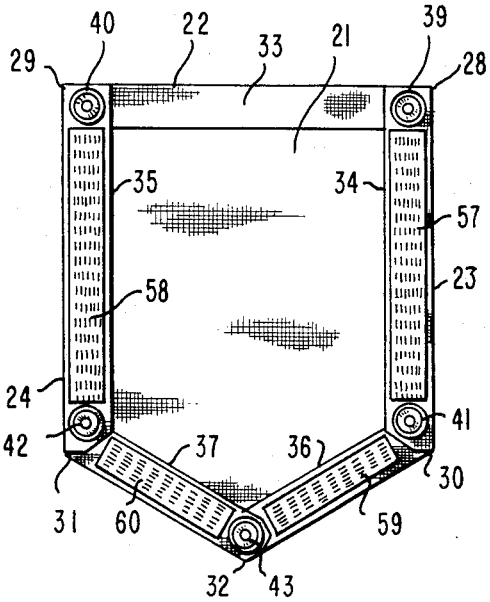
FIG. 3 shows the outer pocket layer of FIG. 2 with the flaps folded against the portions of the pocket material immediately adjacent to them.

The surface of the outer pocket layer 21 visible in FIG. 2 is the surface that would face away from a garment to which the outer pocket layer was attached, and thus may be referred to as the obverse surface. The same surface of the flaps 34–37 is the surface to which straight pieces of Velcro material 57–60 are attached, such as by being sewn thereto. It will be noted that the pieces 57 and 58 extend adjacent the side edges 23 and 24 from locations close to the stud fastener elements 39 and 40 to the stud fastener elements 41 and 42, respectively. In the same manner, one end of the straight piece of Velcro material 59 extends from a location near the stud fastener element 43, but it appears not to terminate near the stud fastener element 41 at the other end. However, after the flaps have been folded over, as shown in FIG. 3, the straight pice 59 is shown as terminating near the stud fastener element 41. Likewise, the straight piece of Velcro material 60 does not appear, in FIG. 2, to terminate near a stud fastener element at either end. However, after the flaps have been folded over, as shown in FIG. 3, it is clear that each end of the straight piece of Velcro material 60 does terminate near a stud fastener element at each of its ends. The cuts that define the ends of the flaps 33–37 are such that they do not interfere with folding the flaps over into the positions shown in FIG. 3 and also do not interfere with allowing the ends of the straight pieces of Velcro material 57–60 to extend so close to the respective stud fastener elements 39–43 that, when the outer pocket layer 21 is attached releasably to a garment, in the manner that the pockets 12 and 13 are shown as being attached in FIG. 1, the side and bottom edges 23–26 will be joined substantially without a gap to the garment.

It does not matter which of the two types of Velcro material is used for the straight pices 57–60 as long as the opposite type for each straight piece is sewn to the garment to cause proper and secure engagement to take place.

Figure 4:
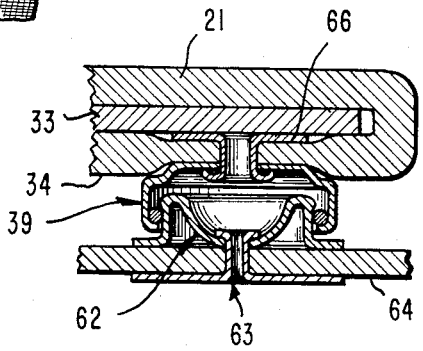
FIG. 4 is an enlarged cross-sectional view along the lines 4—4 in FIG. 3.

FIG. 4 is an enlarged cross-sectional view of one corner of the outer pocket layer 21, and it shows small fragments of the flaps 33 and 34 folded over as they are in FIG. 3. FIG. 4 also shows the stud fastener element 39 gripping a stud fastener element 62 of the converse type. The latter element is firmly retained by a headed retainer 63 in a garment 64, only a small fragment of which is shown. The elements 39 and 62 constitute a complete stud fastener of well-known configuration, and, although the female element 39 is mounted on the flap 34 and the male element 62 on the garment 64 in this embodiment, their locations could just as easily be reversed.

In order to minimize wear due to contact between the stud fastener element 39 and the portion of the outer pocket layer 21 directly overlying it, a protective sheet, or layer of soft material is placed between them. While the protective layer, which need only be large enough to cover the retainer portion 66 of the stud fastener element 39, can be an entirely separate piece of material, in this instance advantage is taken of the availability of the end portion of the next-adjacent flap, which is the flap 33.

What is claimed is:

1. In a combination of a pocket and attachment means for releasably attaching the pocket to a garment, the invention comprising:

(a) an outer pocket layer having at least a top edge, first and second side edges, and a bottom edge, the edges intersecting at at least first, second, third, and fourth corners, the first and second corners being generally above the third and fourth corners, respectively;

(b) a first set of first, second, third, and fourth fastener elements firmly and nonreleasably attached to the outer pocket layer adjacent the first, second, third, and fourth corners, respectively;

(c) a second set of second stud fastener elements comprising fifth, sixth, seventh, and eighth elements firmly and non-releasably attached to the garment in positions to which the first, second, third, and fourth elements, respectively, of the first set are alignable, whereby each of the fastener elements of the first set can be pressed into engagement with a corresponding fastener element of the second set to grip the same firmly but releasably;

(d) a plurality of straight pices of a first type of Velcro material sewn to regions of the outer pocket layer adjacent the bottom edge and the first and second side edges of the outer pocket layer, the total lengths of the straight pieces being such as to extend substantially the entire distances along the second and third edges, respectively, from the first and second stud fastener elements to the third and fourth stud fastener elements, respectively, and along the bottom edge from the third fastener element to the fourth fastener element; and (e) a corresponding plurality of straight pieces of a second type of Velcro material cut as mirror images of the straight pieces of the first type of Velcro material and sewn to regions of the garment from the fifth to the seventh stud fastener element and from the sixth to the eighth stud fastener element, respectively, to engage the corresponding pieces of the first type of Velcro material firmly but releasably, whereby the side edges and the bottom edge of the outer pocket layer are joined, substantially without a gap, to the garment, and that portion of the garment bounded by the pieces of the second type of Velcro material comprises a second layer of the pocket.

2. The combination in claim 1 in which:

(a) the outer pocket layer comprises at least first, second, third, and fourth flaps extending from the top edge, the first and second side edges, and the bottom edge, respectively;

(b) each of the first set of fastener elements is nonreleasably attached to one of the flaps; and (c) the straight pieces of the first type of Velcro material are sewn to separate ones of the flaps.

3. The combination in claim 2 in which the first and third fastener elements are attached to the second flap and the second and fourth fastener elements are attached to the second flap.

4. The combination in claim 2 in which:

(a) each of the flaps is folded into juxtaposition with an edge portion of the respective edge from which that flap extends;

(b) each of the flaps is secured in such juxtaposition with the respective edge portion; and (c) each of the stud fastener elements of the first set passes through the flap to which it is attached and each of the stud fastener elements of the first set has:

(i) a head facing the edge portion juxtaposed to that flap, and (ii) an engagement surface facing away from that edge portion, and the combination further comprises a layer of protective material between each of the heads and that part of the edge portion juxtaposed to the respective head.

5. The combination in claim 4 in which the layer of protective material between each of the heads and the juxtaposed edge portion is a portion of the next-adjacent one of the flaps.

6. In an external garment pocket, the invention comprising:

(a) an outer pocket layer having at least a top edge, first and second side edges intersecting the top edge at first and second upper corners, respectively, and first and second bottom edges intersecting the first and second side edges, respectively, at first and second lower corners, the first and second bottom edges intersecting each other at a fifth corner;

(b) a first set of first, second, third, fourth, and fifth stud fastener elements firmly and nonreleasably attached to the outer pocket layer near the first, second, third, fourth, and fifth corners, respectively;

(c) a first straight piece of a first type of Velcro material sewn to the outer pocket layer and extending from adjacent the first fastener element to a location adjacent to the third fastener element;

(d) a second straight piece of the first type of Velcro material sewn to the outer pocket layer and extending from adjacent the second fastener element to a location adjacent to the fourth fastener element;

(e) third and fourth straight pieces of the first type Velcro material sewn to the outer pocket layer and extending from adjacent the third and fourth fastener elements, respectively, to locations adjacent the fifth fastener element;

(f) a second set of stud fastener elements comprising sixth, seventh, eighth, ninth, and tenth fastener elements firmly and nonreleasably attached to the garment in positions to which the first, second, third, fourth, and fifth fastener elements, respectively, of the first set of stud fastener elements can be pressed into firm but releasable engagement;

(g) a fifth straight piece of a second type of Velcro material sewn to the garment and extending from adjacent the sixth fastener element to a location adjacent the eighth fastener element;

(h) a sixth straight piece of the second type of Velcro material sewn to the garment and extending from adjacent the seventh fastener element to a location adjacent the ninth fastener element;

(i) seventh and eighth straight pieces of the second type of Velcro material sewn to the garment and extending from adjacent the eighth and ninth fastener elements, respectively, to locations adjacent the tenth fastener element, whereby the fifth, sixth, seventh, and eighth straight pieces of Velcro material firmly but releasably hook firmly but releasably onto the first, second, third, and fourth straight pieces of the first type of Velcro material, respectively, when the sixth, seventh, eighth, ninth, and tenth fastener elements are pressed into engagement with the first, second, third, fourth, and fifth fastener elements. respectively, and the portion of the garment bounded by the straight pieces of the second type of Velcro material forms an inner pocket layer, and the side and bottom edges of the outer pocket layer are joined, substantially without a gap, to the garment.

7. The invention as defined in claim 6 in which:

(a) the outer pocket layer comprises an integral portion thereof extending originally outwardly therefrom and divided into a separate flap extending the length of each of the edges, each of the straight pieces of the second type of Velcro material being sewn to a respective one of the flaps; and (b) each of the first set of stud fastener elements passes through one of the flaps at a stud fastener element location such that, when the flaps are all folded into juxtaposition with edge portions of the outer pocket layer, the first set of stud fastener elements will be near the first, second, third, fourth, and fifth corners.

8. The invention as defined in claim 7 in which, for each of the stud fastener elements of the first set thereof, the proximal end portion of the next-adjacent flap is folded to be held between the respective one of the stud fasteners and the juxtaposed portion of the garment.

* * * * *